US008351630B2

(12) United States Patent
Ickler et al.

(10) Patent No.: US 8,351,630 B2
(45) **Date of Patent: *Jan. 8, 2013**

(54) PASSIVE DIRECTIONAL ACOUSTICAL RADIATING

(75) Inventors: Christopher B. Ickler, Sudbury, MA (US); Joseph Jankovsky, Cambridge, MA (US); Eric S. Johanson, Millbury, MA (US); Richard Saffran, Southborough, MA (US)

(73) Assignee: Bose Corporation, Framingham, MA (US)

( * ) Notice: Subject to any disclaimer, the term of this patent is extended or adjusted under 35 U.S.C. 154(b) by 1093 days.

This patent is subject to a terminal disclaimer.

(21) Appl. No.: 12/114,261

(22) Filed: May 2, 2008

(65) Prior Publication Data

US 2009/0274329 A1 Nov. 5, 2009

(51) Int. Cl.
*G10R 1/02* (2006.01)
*G10R 1/20* (2006.01)

(52) U.S. Cl. ..... 381/338; 381/337

(58) Field of Classification Search ..... 381/337, 381/338

See application file for complete search history.

(56) References Cited

U.S. PATENT DOCUMENTS

| | | | | |
|---|---|---|---|---|
| 1,387,490 | A | 8/1921 | Humes | |
| 1,755,636 | A | 4/1930 | Dubilier | |
| 2,225,312 | A * | 12/1940 | Mason | 181/175 |
| 2,293,181 | A | 8/1942 | Terman | |
| 2,318,535 | A | 5/1943 | Spivak | |
| 2,566,094 | A | 8/1951 | Olson et al. | |
| 2,739,659 | A | 3/1956 | Daniels | |
| 2,789,651 | A * | 4/1957 | Daniels | 381/338 |
| 2,913,680 | A * | 11/1959 | Porter et al. | 333/148 |
| 2,939,922 | A * | 6/1960 | Gorike | 381/338 |
| 3,378,814 | A | 4/1968 | Butler | |
| 3,381,773 | A | 5/1968 | Schenkel | |
| 3,486,578 | A | 12/1969 | Albariono | |
| 3,517,390 | A * | 6/1970 | Whitehead | 340/384.73 |
| 3,555,956 | A | 1/1971 | Martin | |
| 3,657,490 | A * | 4/1972 | Scheiber | 381/356 |
| 3,768,589 | A | 10/1973 | Nilsson | |
| 3,930,560 | A | 1/1976 | Carlson et al. | |
| 3,940,576 | A | 2/1976 | Schultz | |
| 3,978,941 | A | 9/1976 | Siebert | |
| 4,251,686 | A | 2/1981 | Sokolich | |
| 4,297,538 | A | 10/1981 | Massa | |
| 4,340,778 | A | 7/1982 | Cowans et al. | |
| 4,340,787 | A | 7/1982 | Gorike | |
| 4,421,957 | A * | 12/1983 | Wallace, Jr. | 381/338 |
| 4,546,459 | A | 10/1985 | Congdon | |
| 4,586,194 | A * | 4/1986 | Kohashi et al. | 381/60 |

(Continued)

FOREIGN PATENT DOCUMENTS

EP 0624045 11/1994

(Continued)

OTHER PUBLICATIONS

Meier, et al.; Ein linienhafter akustischer Gruppenstrahler mit ausgeglichenen Nebenmaxima, Acustica vol. 17 1966, pp. 301-309.

(Continued)

*Primary Examiner* — David S. Warren

(57) ABSTRACT

An acoustic apparatus, including an acoustic driver, acoustically coupled to a pipe to radiate acoustic energy into the pipe. The pipe includes an elongated opening along at least a portion of the length of the pipe through which acoustic energy is radiated to the environment. The radiating is characterized by a volume velocity. The pipe and the opening are configured so that the volume velocity is substantially constant along the length of the pipe.

39 Claims, 11 Drawing Sheets

U.S. PATENT DOCUMENTS

| | | | | |
|---|---|---|---|---|
| 4,628,528 | A | 12/1986 | Bose et al. | |
| 4,646,872 | A | 3/1987 | Kamon et al. | |
| 4,747,142 | A | 5/1988 | Tofte | |
| 4,930,596 | A | 6/1990 | Saiki et al. | |
| 4,942,939 | A | 7/1990 | Harrison | |
| 4,965,776 | A | 10/1990 | Mueller | |
| 5,012,890 | A * | 5/1991 | Nagi et al. | 381/96 |
| 5,022,486 | A * | 6/1991 | Miura et al. | 181/132 |
| 5,105,905 | A | 4/1992 | Rice | |
| 5,137,110 | A * | 8/1992 | Bedard et al. | 181/153 |
| 5,170,435 | A | 12/1992 | Rosen et al. | |
| 5,187,333 | A | 2/1993 | Adair | |
| 5,197,100 | A | 3/1993 | Shiraki | |
| 5,197,103 | A | 3/1993 | Hayakawa | |
| 5,261,006 | A | 11/1993 | Nieuwendijk et al. | |
| 5,276,740 | A | 1/1994 | Inanaga et al. | |
| 5,325,435 | A | 6/1994 | Date et al. | |
| 5,373,564 | A | 12/1994 | Spear et al. | |
| 5,375,564 | A | 12/1994 | Gail | |
| 5,426,702 | A | 6/1995 | Aarts | |
| 5,528,694 | A | 6/1996 | Van De Kerkhof et al. | |
| 5,673,329 | A | 9/1997 | Wiener | |
| 5,740,259 | A | 4/1998 | Dunn | |
| 5,809,153 | A | 9/1998 | Aylward et al. | |
| 5,815,589 | A | 9/1998 | Wainwright et al. | |
| 5,821,471 | A | 10/1998 | McCuller | |
| 5,828,759 | A | 10/1998 | Everingham | |
| 5,832,099 | A | 11/1998 | Wiener | |
| 5,854,450 | A | 12/1998 | Kent | |
| 5,864,100 | A | 1/1999 | Newman | |
| 5,870,484 | A | 2/1999 | Greenberger | |
| 5,940,347 | A * | 8/1999 | Raida et al. | 367/138 |
| 6,002,781 | A | 12/1999 | Takayama et al. | |
| 6,005,952 | A * | 12/1999 | Klippel | 381/71.11 |
| 6,075,868 | A | 6/2000 | Goldfarb et al. | |
| 6,144,751 | A | 11/2000 | Velandia | |
| 6,223,853 | B1 | 5/2001 | Huon et al. | |
| 6,278,789 | B1 * | 8/2001 | Potter | 381/338 |
| 6,356,643 | B2 | 3/2002 | Yamagishi et al. | |
| 6,374,120 | B1 | 4/2002 | Krauss | |
| 6,411,718 | B1 | 6/2002 | Danley et al. | |
| 6,431,309 | B1 | 8/2002 | Coffin | |
| 6,704,425 | B1 | 3/2004 | Plummer | |
| 6,771,787 | B1 * | 8/2004 | Hoefler et al. | 381/338 |
| 6,820,431 | B2 | 11/2004 | McManus et al. | |
| 6,870,933 | B2 | 3/2005 | Roovers | |
| 6,928,169 | B1 | 8/2005 | Aylward | |
| 6,963,647 | B1 | 11/2005 | Krueger et al. | |
| 7,016,501 | B1 | 3/2006 | Aylward et al. | |
| 7,212,467 | B2 * | 5/2007 | Dobbins | 367/138 |
| 7,283,634 | B2 | 10/2007 | Smith | |
| 7,490,044 | B2 | 2/2009 | Kulkarni | |
| 7,536,024 | B2 * | 5/2009 | Bailey et al. | 381/338 |
| 7,542,815 | B1 | 6/2009 | Berchin | |
| 7,623,670 | B2 * | 11/2009 | Hoefler et al. | 381/338 |
| 7,747,033 | B2 | 6/2010 | Uchimura | |
| 7,751,582 | B2 * | 7/2010 | Akino | 381/337 |
| D621,439 | S | 8/2010 | Hamanaga | |
| 7,826,633 | B2 | 11/2010 | Davi | |
| 7,833,282 | B2 * | 11/2010 | Mandpe | 623/23.7 |
| 7,835,537 | B2 * | 11/2010 | Cheney | 381/337 |
| 7,848,535 | B2 * | 12/2010 | Akino | 381/356 |
| 8,066,095 | B1 * | 11/2011 | Bromer | 181/152 |
| 8,175,311 | B2 * | 5/2012 | Aylward | 381/338 |
| 2002/0085731 | A1 * | 7/2002 | Aylward | 381/349 |
| 2002/0194897 | A1 | 12/2002 | Arnott et al. | |
| 2003/0095672 | A1 | 5/2003 | Hobelsberger | |
| 2003/0164820 | A1 | 9/2003 | Kent | |
| 2004/0105559 | A1 | 6/2004 | Aylward et al. | |
| 2004/0173175 | A1 | 9/2004 | Kostun et al. | |
| 2005/0013457 | A1 * | 1/2005 | Sheplak et al. | 381/338 |
| 2005/0036642 | A1 * | 2/2005 | Hoefler et al. | 381/338 |
| 2005/0078831 | A1 | 4/2005 | Irwan et al. | |
| 2005/0205348 | A1 * | 9/2005 | Parker et al. | 181/155 |
| 2005/0205349 | A1 * | 9/2005 | Parker et al. | 181/155 |
| 2005/0254681 | A1 * | 11/2005 | Bailey et al. | 381/396 |
| 2006/0065479 | A1 | 3/2006 | Okawa et al. | |
| 2006/0274913 | A1 | 12/2006 | Akino | |
| 2006/0285714 | A1 | 12/2006 | Akino | |
| 2007/0086606 | A1 | 4/2007 | Goodwin | |
| 2007/0086615 | A1 * | 4/2007 | Cheney | 381/338 |
| 2007/0233036 | A1 * | 10/2007 | Mandpe | 604/514 |
| 2007/0269071 | A1 | 11/2007 | Hooley | |
| 2008/0232197 | A1 | 9/2008 | Kojima et al. | |
| 2009/0003613 | A1 * | 1/2009 | Christensen | 381/58 |
| 2009/0003639 | A1 * | 1/2009 | Aylward | 381/349 |
| 2009/0016555 | A1 * | 1/2009 | Lynnworth | 381/338 |
| 2009/0157575 | A1 | 6/2009 | Schobben et al. | |
| 2009/0208047 | A1 * | 8/2009 | Ngia et al. | 381/338 |
| 2009/0209304 | A1 * | 8/2009 | Ngia et al. | 455/575.2 |
| 2009/0225992 | A1 | 9/2009 | Konagai | |
| 2009/0226004 | A1 * | 9/2009 | Sorensen | 381/92 |
| 2009/0274313 | A1 * | 11/2009 | Klein et al. | 381/59 |
| 2009/0274329 | A1 * | 11/2009 | Ickler et al. | 381/338 |
| 2009/0304189 | A1 | 12/2009 | Vinton | |
| 2009/0323995 | A1 * | 12/2009 | Sibbald | 381/337 |
| 2010/0092019 | A1 * | 4/2010 | Hoefler et al. | 381/338 |
| 2010/0224441 | A1 * | 9/2010 | Fujimori et al. | 181/284 |
| 2010/0290630 | A1 | 11/2010 | Berardi et al. | |
| 2011/0026744 | A1 * | 2/2011 | Jankovsky et al. | 381/306 |
| 2011/0028986 | A1 * | 2/2011 | Mandpe | 606/108 |
| 2011/0096950 | A1 * | 4/2011 | Rougas et al. | 381/338 |
| 2011/0206228 | A1 * | 8/2011 | Shiozawa et al. | 381/353 |
| 2011/0219936 | A1 * | 9/2011 | Masuda et al. | 84/330 |
| 2011/0305359 | A1 | 12/2011 | Ikeda et al. | |
| 2012/0039475 | A1 * | 2/2012 | Berardi et al. | 381/17 |
| 2012/0057736 | A1 * | 3/2012 | Shiozawa et al. | 381/353 |
| 2012/0121118 | A1 * | 5/2012 | Fregoso et al. | 381/337 |

FOREIGN PATENT DOCUMENTS

| | | | |
|---|---|---|---|
| EP | 1577880 | | 9/2005 |
| EP | 1921890 | A2 | 5/2008 |
| EP | 2099238 | A1 | 9/2009 |
| EP | 2104375 | A2 | 9/2009 |
| FR | 1359616 | A | 4/1964 |
| FR | 2653630 | A1 | 4/1991 |
| GB | 631799 | A | 11/1949 |
| GB | 2432213 | | 5/2007 |
| JP | 2007037058 | A | 2/2007 |
| WO | 9611558 | A1 | 4/1996 |
| WO | 9820659 | A1 | 5/1998 |
| WO | 9851122 | A1 | 11/1998 |
| WO | 2004075601 | A1 | 9/2004 |
| WO | 2007007083 | A1 | 1/2007 |
| WO | 2007/052185 | | 5/2007 |
| WO | 2009105313 | A1 | 8/2009 |
| WO | 2009134591 | A1 | 11/2009 |

OTHER PUBLICATIONS

Holland, K. R., et al., A Low Cost End-Fire Acoustic Radiator, Institute of Sound and Vibration Research, University of Southampton, Southampton S095NH, UK, J. audio Eng. Soc., vol. 39, No. 7/8, Jul./Aug. 1991, pp. 540-550.

Reams, et al., The Karlson-Hypex Bass Enclosure, AES, An audio engineering Society Preprint, presented at the 57th Convention, May 10-13, 1977, Los Angeles, CA.

Olson, Harry F., Directional Microphones, Journal of the Audio Engineering Society, RCA Laboratories, Princeton, NJ, pp. 420-430.

Poppe, Martin C., The K-Coupler, A New Acoustical-Impedance Transformer, IEEE Transactions on Audio and Electroacoustics, pp. 163-167, Dec. 1966.

Korn, T.S., A Corner Loudspeaker with Coaxial Acoustical Line, Journal of the Audio Engineering Society, vol. 5, No. 3, Jul. 1957, pp. 138-141.

Ramsey, Robert C., A New Cardiod-Line Microphone, Audio Engineering Society, NY, NY, Oct. 5-9, 1959.

Shulman, Yuri, Reducing Off-Axis Comb Filter Effects in Highly Directional Microphones, Audio Engineering Society, Presented at the 81st Convention, Los Angeles, CA, Nov. 12-16, 1986.

Purolator Acoustic Porous Metals, Acoustic Media for Aviation Applications, Aerospace Acoustic Materials, Acoustic Media for Helicopters, pp. 1-4, http://www.purolator-facet.com/acoustic.htm. First publication date not known; Date known to exist: Nov. 20, 2007.

International Search Report and Written Opinion dated Apr. 27, 2011 for PCT/US2011/024674.
International Search Report and Written Opinion dated Jul. 15, 2009 for PCT/US2009/039709.
Boone, Marinus, M. et al; "Design of a Highly Directional Endfire Loudspeaker Array". J. Audio Eng. Doc., vol. 57, No. 5, May 2009. pp. 309-325.
Van Der Wal, Menno, et al.; "Design of Logarithmically Spaced Constant-Directivity Transducer Arrays". J. Audio Eng. Soc., vol. 44, No. 6, Jun. 1996. pp. 497-507.
Ward, Darren B., et al.; "Theory and Design of Broadband Sensor Arrays with Frequency Invariant Far-field Beam Patterns". J. Acounstic Soc. Am. 97 (2), Feb. 1995. pp. 1023-1034.
Moulton Dave, The Center Channel: Unique and Difficult; TV Technology, Published Oct. 5, 2005. Retrieved May 13, 2009 from: http://www.tvtechnology.com/article/11798.
Rubinson Kalman, Music in the Round #4, Stereophile, Published Mar. 2004; Retrieved May 13, 2009 from http://www.stereophile.com/musicintheround/304round/.
Silva Robert, Surround Sound—What You Need to Know, The History and Basics of Surround Sound, Retrieved May 13, 2009 from http://hometheater.about.com/od/beforeyoubuy/a/surroundsound.htm.
Linkwitz Siegfried, Surround Sound, Linkwitz Lab, Accurate Reproduction and Recording of Auditory Scenes, Revised Publication Jan. 15, 2009. Retreived May 13, 2009 from http://www.linkwitzlab.com/surround_system.htm.
International Search Report and Written Opinion dated Apr. 28, 2009 for PCT/US2009/032241.
Munjal, M. L, Acoustics of Ducts and Mufflers with Application to Exhaust and Ventilation System Design, 1987, pp. 42-152, John Wiley & Sons, New York, NY.
Augspurger, G.L., Loudspeakers on Damped Pipes, J. Audio Eng. Soc., vol. 48, No. 5, May 2000, pp. 424-436, Perception Inc., Los Angeles, CA.
European Examination Report dated Jul. 21, 2008 for EP Appln. No. 02026327.3.
Japanese Office Action dated Feb. 23, 2009 for related JP Application No. H11-250309.
International Preliminary Report on Patentability dated Feb. 18, 2010 for PCT/US2009/032241.
Baily, A. R. "Non-resonant Loudspeaker Enclosure Design", Wireless World, Oct. 1965.
International Preliminary Report on Patentability dated May 19, 2010 for PCT/US2009/032241.
International Preliminary Report on Patentability dated Jul. 16, 2010 for PCT/US2009/039709.
Backgrounder; Technical Overview: Zenith/Bose Television Sound System, Summer/Fall 1986, Zenith Electronics Corporation, 1000 Milwaukee Avenue, Glenview, Illinois 60025, 8 pages.
International Search Report and Written Opinion dated Nov. 2, 2011 for PCT/US2011/047429.

* cited by examiner 10
19
20
18
14
16

34
10
18
14
24
Θ
Φ
19
16
30

14
18
20
10

19
34
16
10
14
18
20

19
34
16
10

14
18
20
19
34
16

10
15
16
18
20
25
30
32
34
Φ
Θ

16
58
18A
56
18B
54
52

16
58
18
56
54
52

58
18B
52
16
56
54
18A

PASSIVE DIRECTIONAL ACOUSTICAL RADIATING

BACKGROUND

This specification describes a loudspeaker with passively controlled directional radiation.

FIG. 1 shows a prior art end-fire acoustic pipe radiator suggested by FIG. 4 of Holland and Fahy, "*A Low-Cost End-Fire Acoustic Radiator", J Audio Engineering Soc.* Vol. 39, No. 7/8, 1991 July/August. An end-fire pipe radiator includes a pvc pipe 16 with an array of holes 12. If "a sound wave passes along the pipe, each hole acts as an individual sound source. Because the output from each hole is delayed, due to the propagation of sound along the pipe, by approximately $l/c_o$ (where l is the distance between the holes and $c_0$ is the speed of sound), the resultant array will beam the sound in the direction of the propagating wave. This type of radiator is in fact the reciprocal of the 'rifle' or 'gun' microphones used in broadcasting and surveillance." (p. 540)

"The predictions of directivity from the mathematical model indicate that the radiator performs best when the termination impedance of the pipe is set to the characteristic impedance $\rho_0 c_0/S$ [where $\rho_0$ is the density of air, $c_0$ is the speed of sound, and S is the cross-sectional area of the pipe]. This is the condition that would be present if the pipe were of infinite length beyond the last hole. If $Z_0$ [the termination impedance] were made to be in any way appreciably different from $\rho_0 c_0/S$, instead of the radiator radiating sound predominantly in the forward direction, the reflected wave, a consequence of the impedance discontinuity, would cause sound to radiate backward as well. (The amount of 'reverse' radiation depends on how different $Z_0$ is from $\rho_0 c_0/S$.)" (p. 543)

"The two simplest forms of pipe termination, namely, open and closed both have impedances that are very different from $\rho_0 c_0/S$ and are therefore unsuitable for this system. . . . [An improved result with a closed end radiator] was achieved by inserting a wedge of open-cell plastic foam with a point at one end and a diameter about twice that of the pipe at the other. The complete wedge was simply pushed into the end of the pipe" (p. 543)

Good examples of rifle microphones achieve more uniform results over a wider range of frequencies than the system of holes described. This is achieved by covering the holes, or sometimes a slot, with a flow-resistive material. The effect of this is similar to that described [elsewhere in the article] for the viscous flow resistance of the holes, and it allows the system to perform better at lower frequencies. The problem with this form of treatment is that the sensitivity of the system will suffer at higher frequencies" (p. 550).

SUMMARY

In one aspect an acoustic apparatus includes an acoustic driver, acoustically coupled to a pipe to radiate acoustic energy into the pipe. The pipe includes an elongated opening along at least a portion of the length of the pipe through which acoustic energy is radiated to the environment. The radiating is characterized by a volume velocity. The pipe and the opening are configured so that the volume velocity is substantially constant along the length of the pipe. The pipe may be configured so that the pressure along the pipe is substantially constant. The cross-sectional area may decrease with distance from the acoustic driver. The device may further include acoustically resistive material in the opening. The resistance of the acoustically resistive material may vary along the length of the pipe. The acoustically resistive material may be wire mesh. The acoustically resistive material may be sintered plastic. The acoustically resistive material may be fabric. The pipe and the opening may be configured and dimensioned and the resistance of the resistive material may be selected so that substantially all of the acoustic energy radiated by the acoustic driver is radiated through the opening before the acoustic energy reaches the end of the pipe. The width of the opening may vary along the length of the pipe. The opening may be oval shaped. The cross-sectional area of the pipe may vary along the length of the pipe. The opening may lie in a plane that intersects the pipe at a non-zero, non-perpendicular angle relative to the axis of the acoustic driver. The pipe may be at least one of bent or curved. The opening may be at least one of bent or curved along its length. The opening may be in a face that is at least one of bent or curved. The opening may lie in a plane that intersects an axis of the acoustic driver at a non-zero, non-perpendicular angle relative to the axis of the acoustic driver. The opening may conform to an opening formed by cutting the pipe at a non-zero, non-perpendicular angle relative the axis. The pipe and the opening may be configured and dimensioned so that substantially all of the acoustic energy radiated by the acoustic driver is radiated through the opening before the acoustic energy reaches the end of the pipe. The acoustic driver may have a first radiating surface acoustically coupled to the pipe and the acoustic driver may have a second radiating surface coupled to an acoustic device for radiating acoustic energy to the environment. The acoustic device may be a second pipe that includes an elongated opening along at least a portion of the length of the second pipe through which acoustic energy is radiated to the environment. The radiating may be characterized by a volume velocity. The pipe and the opening may be configured so that the volume velocity is substantially constant along the length of the pipe. The acoustic device may include structure to reduce high frequency radiation from the acoustic enclosure. The high frequency radiation reducing structure may include damping material. The high frequency radiation reducing structure may include a port configured to act as a low pass filter.

In another aspect, a method for operating a loudspeaker device includes radiating acoustic energy into a pipe and radiating the acoustic energy from the pipe through an elongated opening in the pipe with a substantially constant volume velocity. The radiating acoustic energy from the pipe may include radiating the acoustic energy so that the pressure along the opening is substantially constant. The method may further include radiating the acoustic energy from the pipe through the opening through acoustically resistive material. The acoustically resistive material may vary in resistance along the length of the pipe. The method may include radiating the acoustic energy from the pipe though wire mesh. The method may include radiating the acoustic energy from the pipe though a sintered plastic sheet. The method may include radiating the acoustic energy from the pipe through an opening that varies in width along the length of the pipe. The method may include radiating the acoustic energy from the pipe through an oval shaped opening. The method may include radiating acoustic energy into a pipe that varies in cross-sectional area along the length of the pipe. The method may include radiating acoustic energy into at least one of a bent or curved pipe. The method may further include radiating acoustic energy from the pipe through an opening that is at least one of bent or curved along its length. The method may further include radiating acoustic energy from the pipe through an opening in a face of the pipe that is at least one of bent or curved. The method may further include radiating acoustic energy from the pipe through an opening lying in a plane that intersects a axis of the acoustic driver at a non-zero, non-perpendicular angle. The method may further include radiating acoustic energy from the pipe through an opening that conforms to an opening formed by cutting the pipe at a non-zero, non-perpendicular angle relative the axis. The method may further include radiating substantially all of the energy from the pipe before the acoustic energy reaches the end of the pipe.

In another aspect, an acoustic apparatus includes an acoustic driver, acoustically coupled to a pipe to radiate acoustic energy into the pipe. The pipe includes an elongated opening along at least a portion of the length of the pipe through which acoustic energy is radiated to the environment. The opening lies in a plane that intersects an axis of the acoustic driver at a non-zero, non-perpendicular angle relative to the axis of the acoustic driver. The apparatus may further include acoustically resistive material in the opening In another aspect, an acoustic apparatus, includes an acoustic driver, acoustically coupled to a pipe to radiate acoustic energy into the pipe; and acoustically resistive material in all openings in the pipe so that all acoustic energy radiated from the pipe to the environment from the pipe exits the pipe through the resistive opening Other features, objects, and advantages will become apparent from the following detailed description, when read in connection with the following drawing, in which:

DETAILED DESCRIPTION

Figures 1, 2A, 2B:
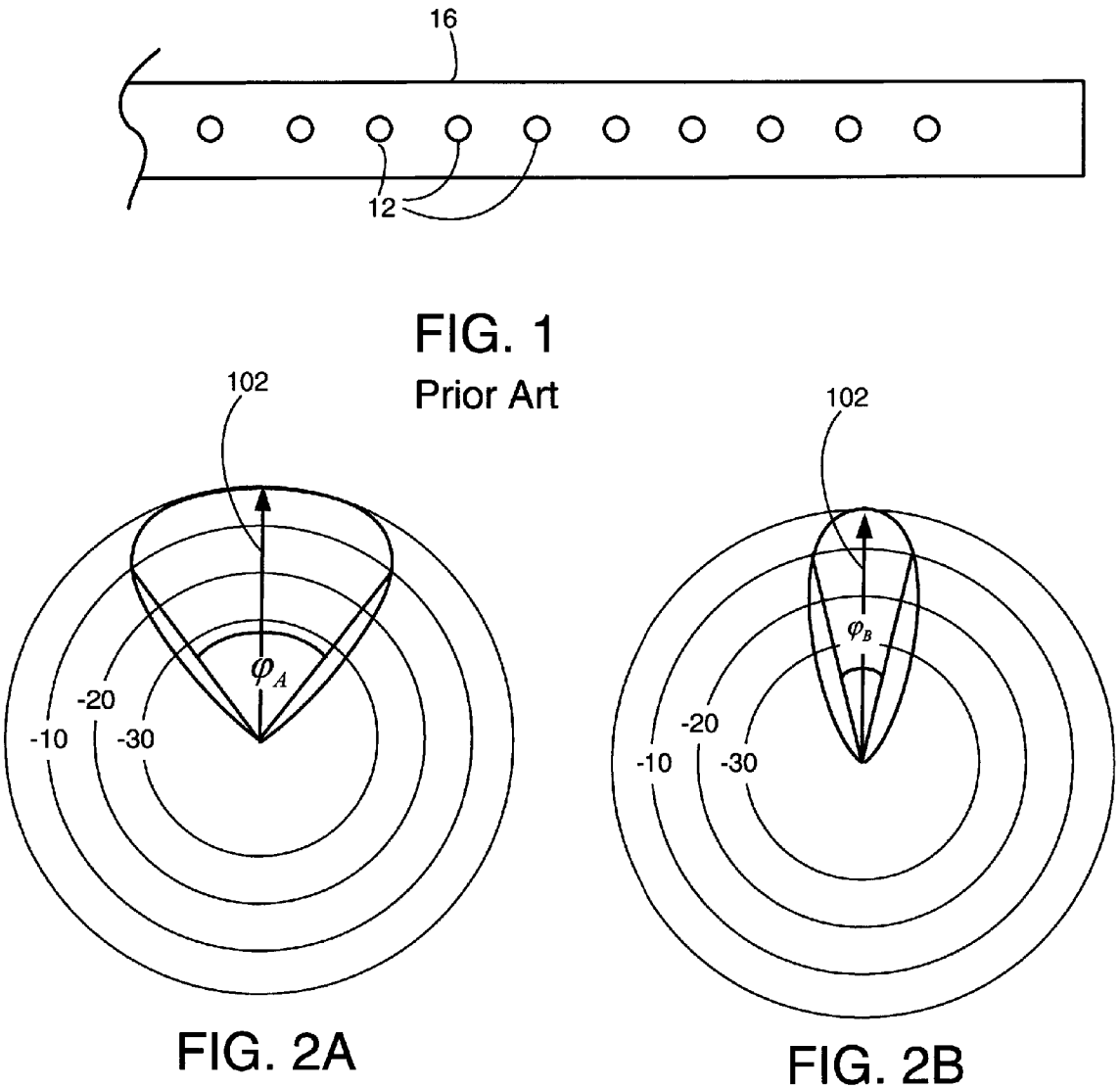
FIG. 1 Prior Art
FIG. 1 is a prior art end-fire acoustic pipe radiator.
FIGS. 2A and 2B are polar plots.

Though the elements of several views of the drawing may be shown and described as discrete elements in a block diagram and may be referred to as "circuitry", unless otherwise indicated, the elements may be implemented as one of, or a combination of, analog circuitry, digital circuitry, or one or more microprocessors executing software instructions. The software instructions may include digital signal processing (DSP) instructions. Unless otherwise indicated, signal lines may be implemented as discrete analog or digital signal lines, as a single discrete digital signal line with appropriate signal processing to process separate streams of audio signals, or as elements of a wireless communication system. Some of the processing operations may be expressed in terms of the calculation and application of coefficients. The equivalent of calculating and applying coefficients can be performed by other analog or digital signal processing techniques and are included within the scope of this patent application. Unless otherwise indicated, audio signals or video signals or both may be encoded and transmitted in either digital or analog form; conventional digital-to-analog or analog-to-digital converters may not be shown in the figures. For simplicity of wording "radiating acoustic energy corresponding to the audio signals in channel x" will be referred to as "radiating channel x." The axis of the acoustic driver is a line in the direction of vibration of the acoustic driver.

As used herein, "directional loudspeakers" and "directional loudspeaker assemblies" are loudspeakers that radiate more acoustic energy of wavelengths large (for example 2×) relative to the diameter of the radiating surface in some directions than in others. The radiation pattern of a directional loudspeaker is typically displayed as a polar plot (or, frequently, a set of polar plots at a number of frequencies). FIGS. 2A and 2B are examples of polar plots. The directional characteristics may be described in terms of the direction of maximum radiation and the degree of directionality. In the examples of FIGS. 2A and 2B, the direction of maximum radiation is indicated by an arrow 102. The degree of directionality is often described in terms of the relative size of the angle at which the amplitude of radiation is within some amount, such as −6 dB or −10 dB from the amplitude of radiation in the direction of maximum radiation. For example, the angle $\phi_A$ of FIG. 2A is greater than the angle $\phi_B$ of FIG. 2B, so the polar plot of FIG. 2A indicates a directional loudspeaker that is less directional than the directional loudspeaker described by the polar plot of FIG. 2B, and the polar plot of FIG. 2B indicates a directional loudspeaker that is more directional than the directional loudspeaker described by the polar plot of FIG. 2A. Additionally, the directionality of loudspeakers tends to vary by frequency. For example, if the polar plots of FIGS. 2A and 2B represent polar plots of the same loudspeaker at different frequencies, the loudspeaker is described as being more directional at the frequency of FIG. 2B than at the frequency of FIG. 2A.

Figure 3:
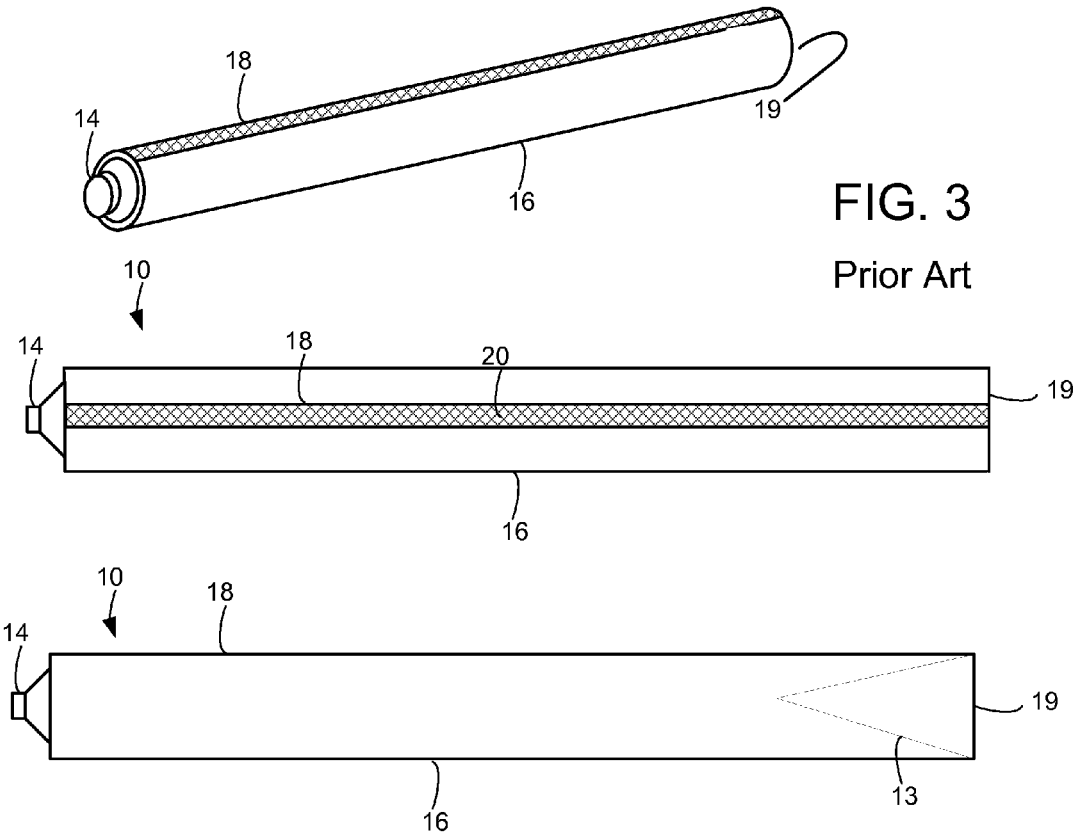
FIG. 3 Prior Art
FIG. 3 is a directional loudspeaker assembly suggested by a prior art document.

Referring to FIG. 3, a directional loudspeaker assembly 10, as suggested as a possibility for further research in section 6.4 of the Holland and Fahy article, includes pipe 16 with a slot or lengthwise opening 18 extending lengthwise in the pipe. Acoustic energy is radiated into the pipe by the acoustic driver and exits the pipe through the acoustically resistive material 20 as it proceeds along the length of the pipe. Since the cross-sectional area of the pipe is constant, the pressure decreases with distance from the acoustic driver. The pressure decrease results in the volume velocity u through the screen decreasing with distance along the pipe from the acoustic driver. The decrease in volume velocity results in undesirable variations in the directional characteristics of the loudspeaker system.

There is an impedance mismatch at the end 19 of the pipe resulting from the pipe being terminated by a reflective wall or because of the impedance mismatch between the inside of the pipe and free air. The impedance mismatch at the termination of the pipe can result in reflections and therefore standing waves forming in the pipe. The standing waves can cause an irregular frequency response of the waveguide system and an undesired radiation pattern. The standing wave may be attenuated by a wedge of foam 13 in the pipe. The wedge absorbs acoustic energy which is therefore not reflected nor radiated to the environment.

Figures 4A, 4B, 4C, 4D, 4E:
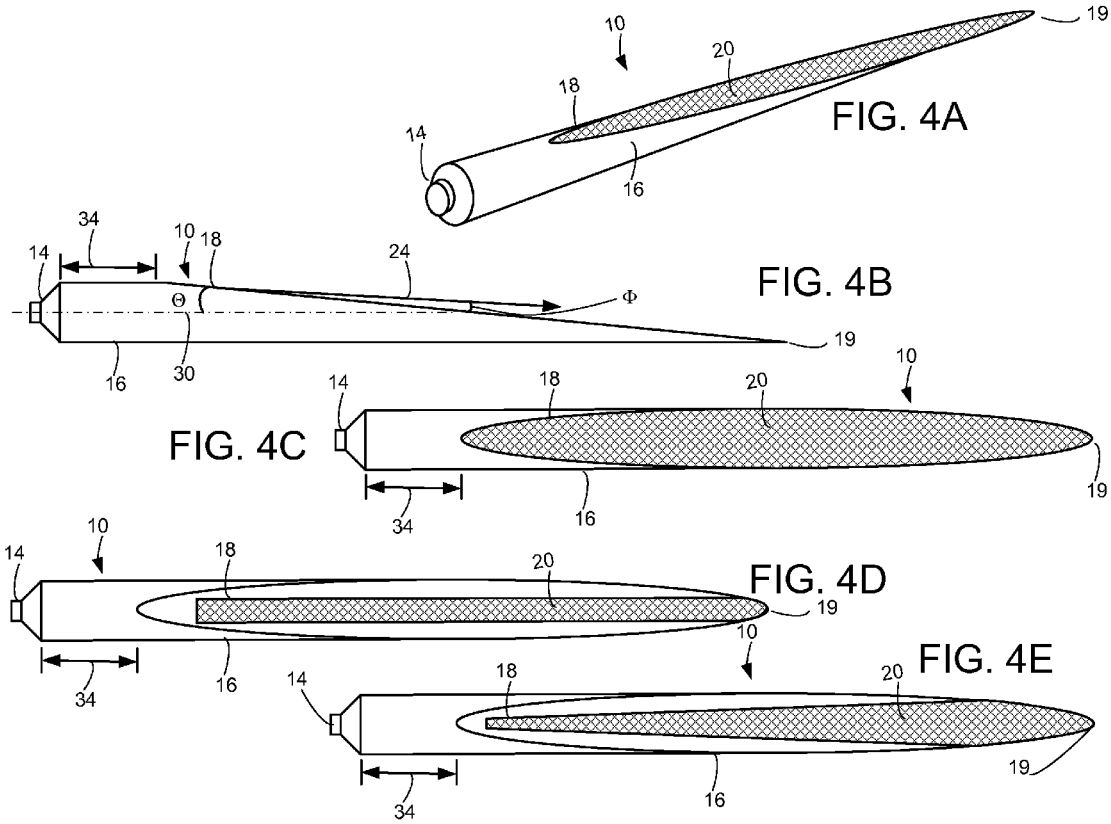
FIGS. 4A-4E are diagrammatic views of a directional loudspeaker assembly.

FIGS. 4A-4E show a directional loudspeaker assembly 10. An acoustic driver 14 is acoustically coupled to a round (or some other closed section) pipe 16. For purposes of explanation, the side of the acoustic driver 14 facing away from the pipe is shown as exposed. In actual implementations of subsequent figures, the side of the acoustic driver 14 facing away from the pipe is enclosed so that the acoustic driver radiates only into pipe 16. There is a lengthwise opening 18 in the pipe described by the intersection of the pipe with a plane oriented at a non-zero, non-perpendicular angle Θ relative to the axis 30 of the acoustic driver. In an actual implementation, the opening could be formed by cutting the pipe at an angle with a planar saw blade. In the lengthwise opening 18 is placed acoustically resistive material 20. In FIGS. 4D and 4E, there is a planar wall in the intersection of the plane and the pipe and a lengthwise opening 18 in the planar wall. The lengthwise opening 18 is covered with acoustically resistive material 20.

In operation, the combination of the lengthwise opening 18 and the acoustically resistive material 20 act as a large number of acoustic sources separated by small distance, and produces a directional radiation pattern with a high radiation direction as indicated by the arrow 24 at an angle ϕ relative to the plane of the lengthwise opening 18. The angle ϕ may be determined empirically or by modeling and will be discussed below.

Acoustic energy is radiated into the pipe by the acoustic driver and radiates from the pipe through the acoustically resistive material 20 as it proceeds along the length of the pipe as in the waveguide assemblies of FIG. 3. However, since the cross-sectional area of the pipe decreases, the pressure is more constant along the length of the pipe than the directional loudspeaker of FIG. 3. The more constant pressure results in more uniform volume velocity along the pipe and through the screen and therefore more predictable directional characteristics. The width of the slot can be varied as in FIG. 4E to provide an even more constant pressure along the length of the pipe, which results in even more uniform volume velocity along the length of the pipe.

The acoustic energy radiated into the pipe exits the pipe through the acoustically resistive material, so that at the end 19 of the pipe, there is little acoustic energy in the pipe. Additionally, there is no reflective surface at the end of the pipe. A result of these conditions is that the amplitude of standing waves that may form is less. A result of the lower amplitude standing waves is that the frequency response of the loudspeaker system is more regular than the frequency response of a loudspeaker system that supports standing waves. Additionally, the standing waves affect the directionality of the radiation, so control of directivity is improved.

One result of the lower amplitude standing waves is that the geometry, especially the length, of the pipe is less constrained than in a loudspeaker system that supports standing waves. For example, the length 34 of the section of pipe from the acoustic driver 14 to the beginning of the slot 18 can be any convenient dimension.

In one implementation, the pipe 16 is 2.54 cm (1 inch) nominal diameter pvc pipe. The acoustic driver is a conventional 2.54 cm (one inch) dome tweeter. The angle Θ is about 10 degrees. The acoustically resistive material 20 is wire mesh Dutch twill weave 65×552 threads per cm (165×1400 threads per inch). Other suitable materials include woven and unwoven fabric, felt, paper, and sintered plastic sheets, for example Porex® porous plastic sheets available from Porex Corporation, url www.porex.com.

Figures 5A, 5B, 5C, 5D, 5E:
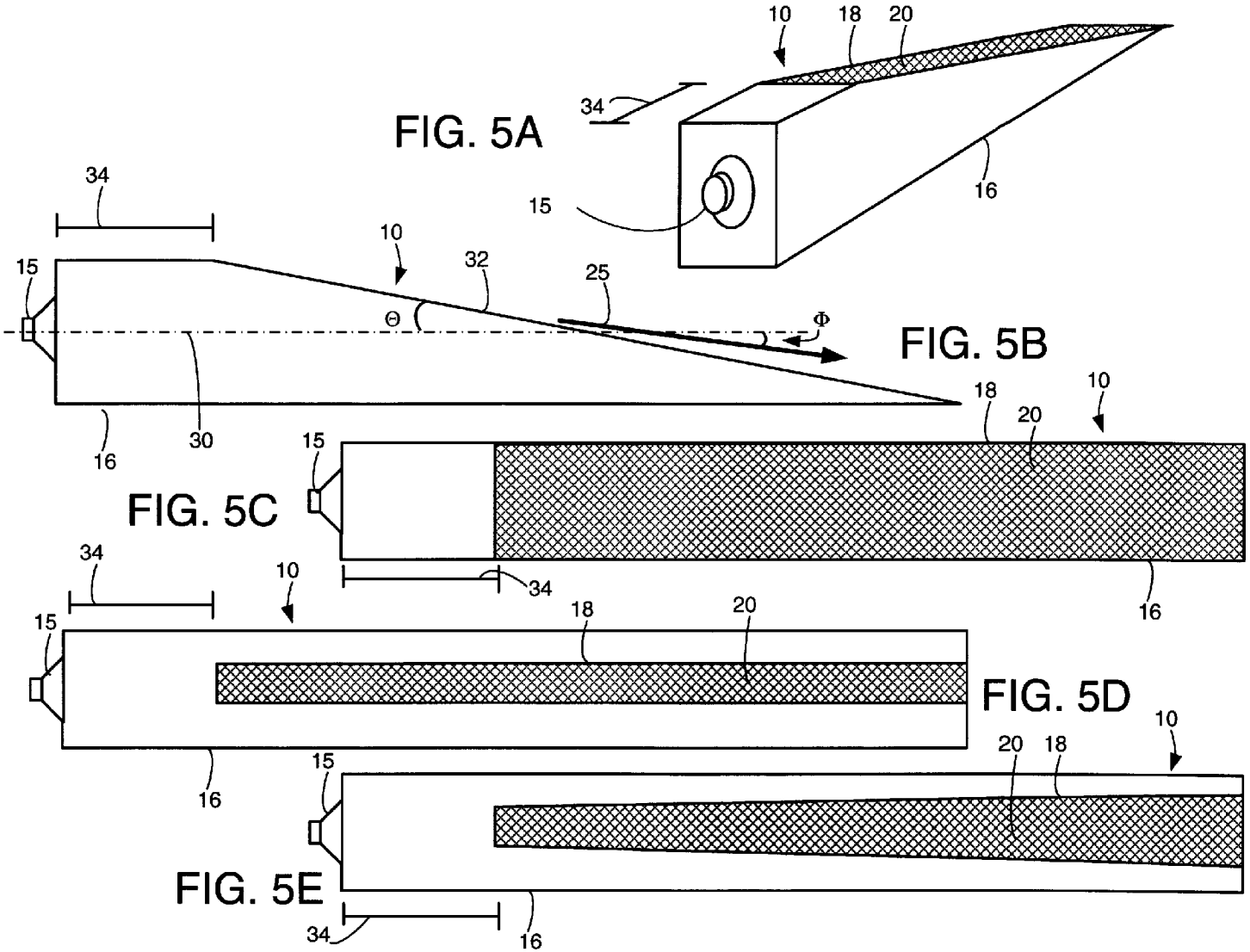
FIGS. 5A-5G are diagrammatic views of directional loudspeaker assemblies.

FIGS. 5A-5E show another loudspeaker assembly similar to the loudspeaker assembly of FIGS. 4A-4E, except that the pipe 16 has a rectangular cross-section. In the implementation of FIGS. 5A-5E, the slot 18 lies in the intersection of the waveguide and a plane that is oriented at a non-zero non-perpendicular angle Θ relative to the axis 30 of the acoustic driver. In the implementation of FIGS. 5A and 5C, the lengthwise opening is the entire intersection of the plane and the pipe. In the implementation of FIG. 5D, the lengthwise opening is an elongated rectangular portion of the intersection of the plane and the pipe so that a portion of the top of the pipe lies in the intersecting plane. In the implementation of FIG. 5E, the lengthwise opening is non-rectangular, in this case an elongated trapezoidal shape such that the width of the lengthwise opening increases with distance from the acoustic driver.

Acoustic energy radiated by the acoustic driver radiates from the pipe through the acoustically resistive material 20 as it proceeds along the length of the pipe. However, since the cross-sectional area of the pipe decreases, the pressure is more constant along the length of the pipe than the directional loudspeaker of FIG. 3. Varying the cross-sectional area of the pipe is one way to achieve a more constant pressure along the length of the pipe, which results in more uniform volume velocity along the pipe and therefore more predictable directional characteristics.

In addition to controlling the pressure along the pipe, another method of controlling the volume velocity along the pipe is to control the amount of energy that exits the pipe at points along the pipe. Methods of controlling the amount of energy that exits the pipe at points along the pipe include varying the width of the slot 18 and using for acoustically resistive material 20 a material that that has a variable resistance. Examples of materials that have variable acoustic resistance include wire mesh with variable sized openings or sintered plastics sheets of variable porosity or thickness.

Figure 5F:
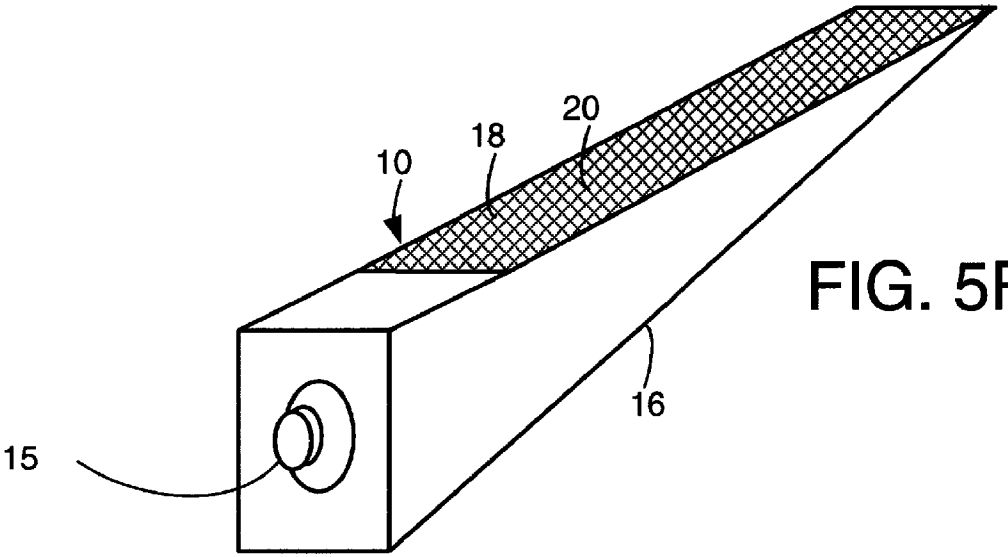
Figure 5G:
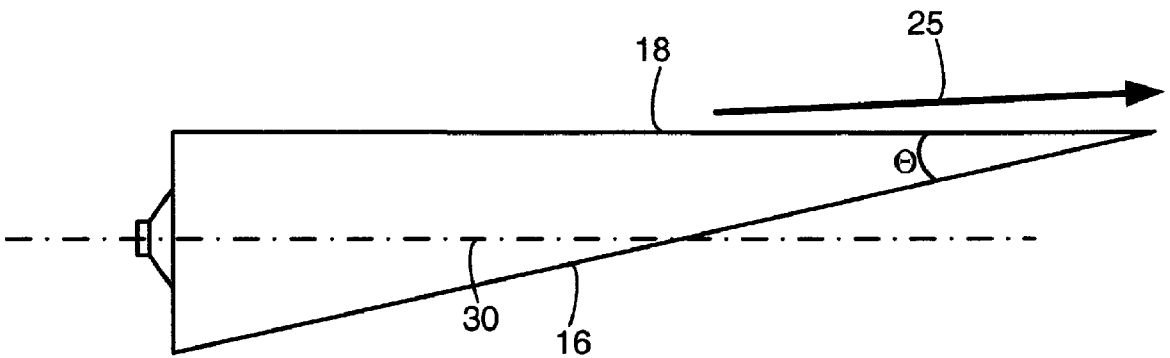

The loudspeaker assembly of FIGS. 5F and 5G is similar to the loudspeaker assemblies of FIGS. 5A-5E, except that the slot 18 with the acoustically resistive material 20 is in a wall that is parallel to the axis 30 of the acoustic driver. A wall, such as wall 32 of the pipe is non-parallel to the axis 30 of the acoustic driver, so that the cross sectional area of the pipe decreases in the direction away from the acoustic driver. The loudspeaker assembly of FIGS. 5F and 5G operates in a manner similar to the loudspeaker assemblies of FIGS. 5A-5E.

Figures 6A, 6B, 6C:
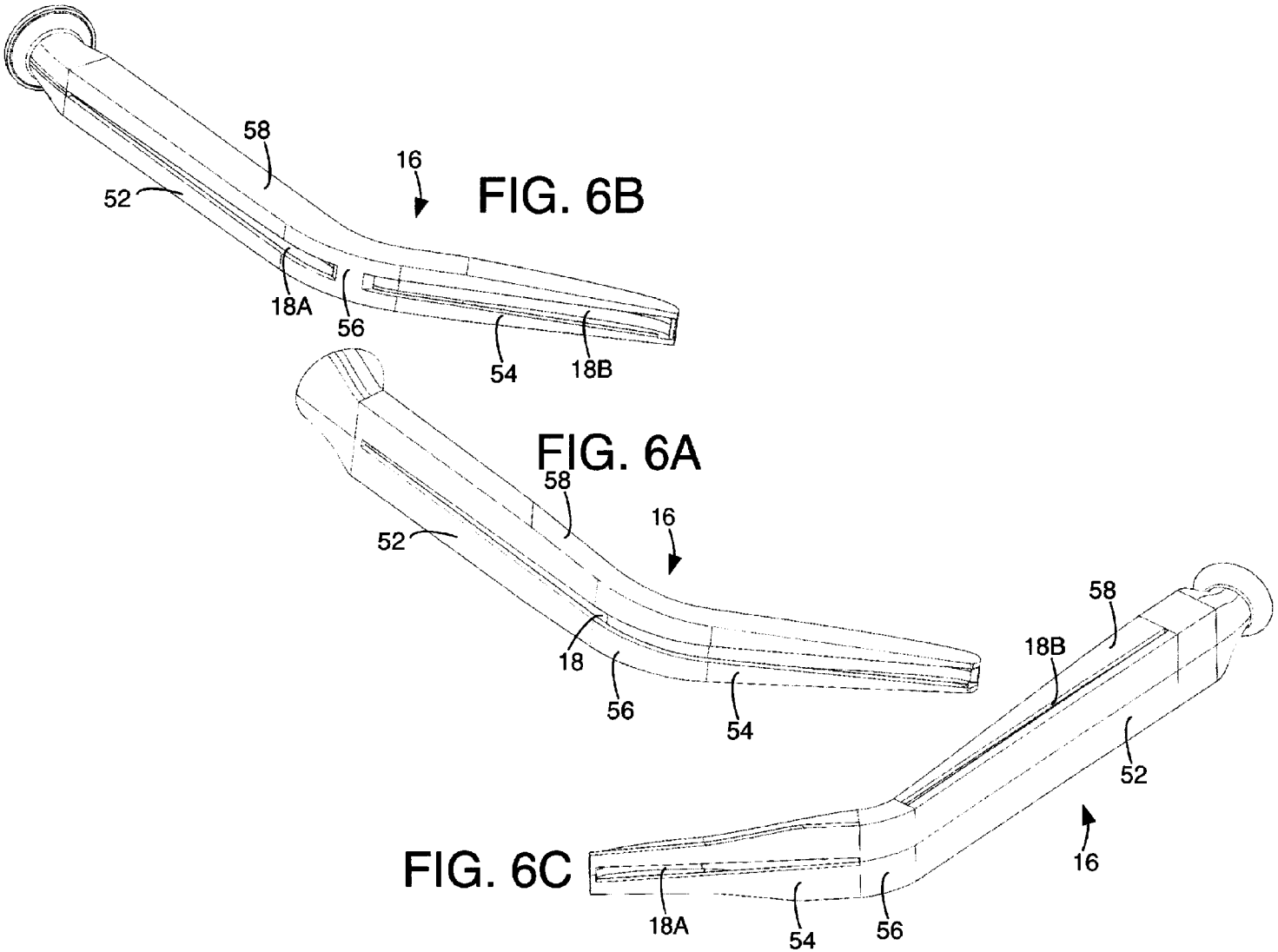
FIGS. 6A-6C are isometric views of pipes for directional loudspeaker assemblies.

One characteristic of directional loudspeakers according to FIGS. 3A-5G is that they becomes more directional at higher frequencies (that is, at frequencies with corresponding wavelengths that are much shorter than the length of the slot 18). In some situations, the directional loudspeaker may become more directional than desired at higher frequencies. FIGS. 6A-6C show isometric views of pipes 16 for directional loudspeakers that are less directional at higher frequencies than directional loudspeakers described above. In FIGS. 6A-6G, the reference numbers identify elements that correspond to elements with similar reference numbers in the other figures. Loudspeakers using the pipes of FIGS. 6A-6C and 6F-6G may use compression drivers. Some elements common in compression driver structures, such as phase plugs may be present, but are not shown in this view. In the pipes of FIGS. 6A-6C, the slot 18 is bent. In the pipe of FIG. 6A a section 52 of one face 56 of the pipe is bent relative to another section 54 in the same face of the pipe, with the slot 18 in face 56, so that the slot bends. At high frequencies, the direction of directivity is in the direction substantially parallel to the slot 18. Since slot 18 bends, directional loudspeaker with a pipe according to FIG. 6A is less directional at high frequencies than a directional loudspeaker with a straight slot. Alternatively, the bent slot could be in a substantially planar face 58 of the pipe. In the implementation of FIG. 6B, the slot has two sections, 18A and 18B. In the implementation of FIG. 6C, the slot has two sections, one section in face 56 and one section in face 58.

Figure 6D:
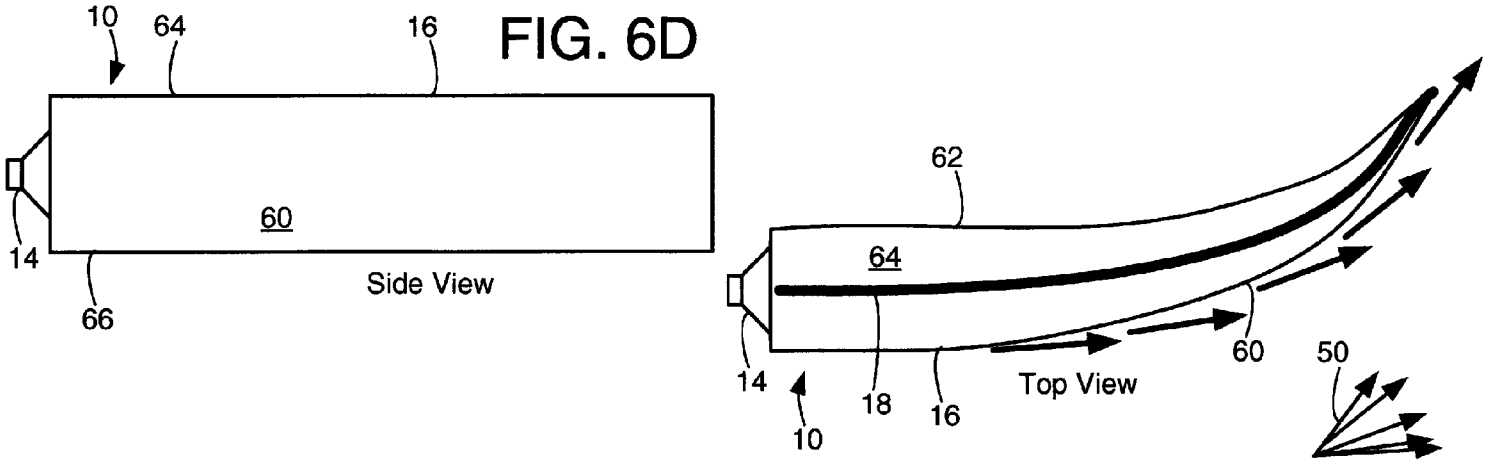
FIGS. 6D and 6E are diagrammatic views of a directional loudspeaker assembly.
Figure 6E:
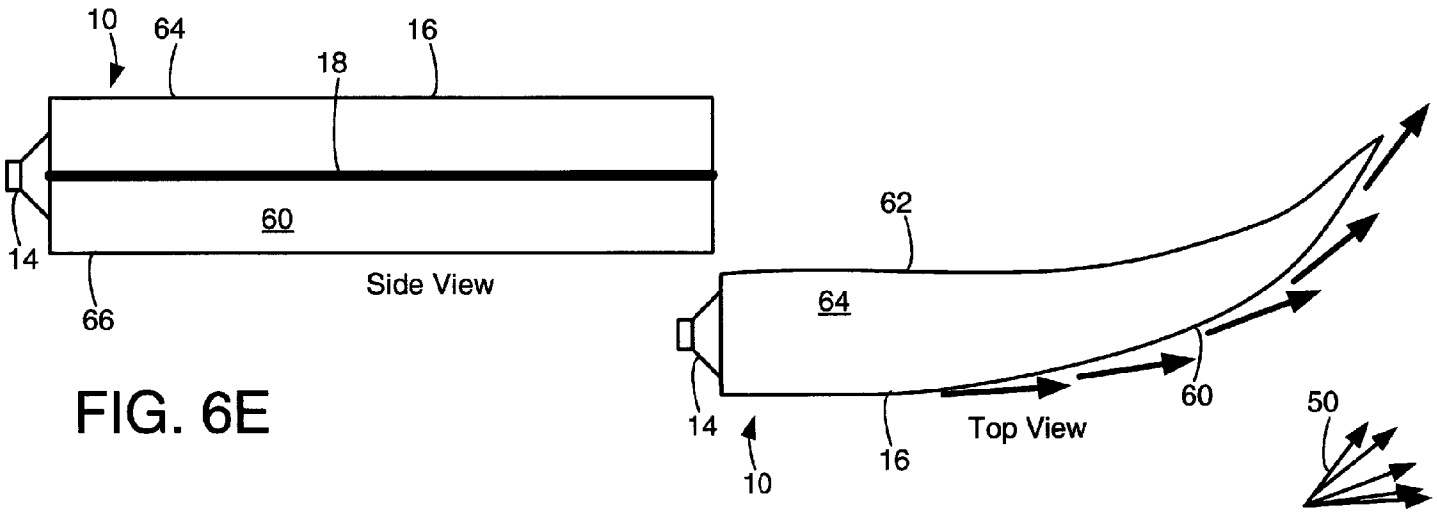
Figure 6F:
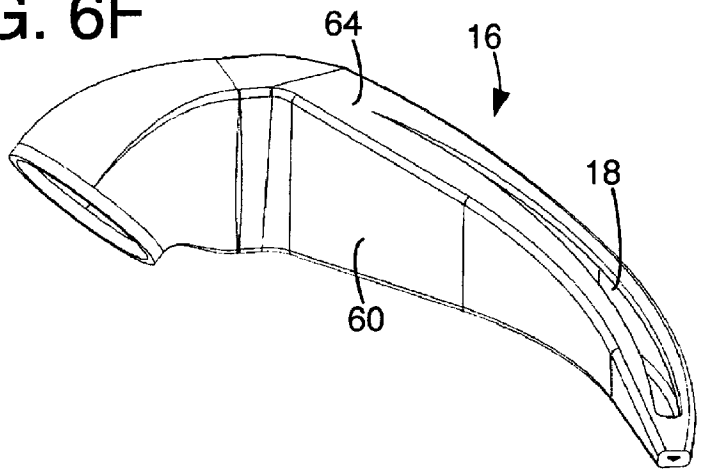
FIGS. 6F and 6G are isometric views of pipes for directional loudspeaker assemblies.
Figure 6G:
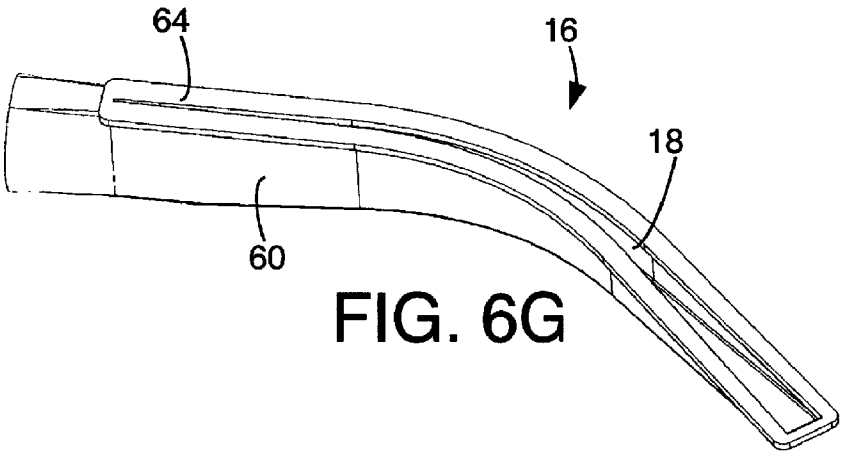

An alternative to a bent pipe is a curved pipe. The length of the slot and degree of curvature of the pipe can be controlled so that the degree of directivity is substantially constant over the range of operation of the loudspeaker device. FIGS. 6D and 6E show plan views of loudspeaker assemblies with a pipe that has two curved faces 60 and 62, and two planar faces 64 and 66. Slot 18 is curved. The curve may be formed by placing the slot in a planar surface and curving the slot to generally follow the curve of the curved faces, as shown in FIG. 6D. Alternatively, the curve may be formed by placing the slot in a curved face, as in FIG. 6E so that the slot curves in the same manner as the curved face. The direction of maximum radiation changes continuously as indicated by the arrows. At high frequencies, the directivity pattern is less directional than with straight pipe as indicated by the overlaid arrows 50 so that loudspeaker assembly 10 has the desired degree of directivity at high frequencies. At lower frequencies, that is at frequencies with corresponding wavelengths that are comparable to or longer than the projected length of the slot 18) the degree of directivity is controlled by the length of the slot 18. Generally, the use of longer slots results in greater directivity at lower frequencies and the use of shorter slots results in less directivity at lower frequencies. FIGS. 6F and 6G are isometric views of pipes that have two curved faces (one curved face 60 is shown), and two planar faces (one planar face 64 is shown). Slot 18 is curved. The curve may be formed by placing the slot in a planar surface 64 and curving the slot to generally follow the curve of the curved faces, as shown. Alternatively, the slot 16 may be placed in a curved surface 60, or the slot may have more than one section, with a section of the slot in a planar face and a section of the slot in a curved surface, similar to the implementation of FIG. 6C.

The varying of the cross-sectional area, the width of the slot, the amount of bend or curvature of the pipe, and the resistance of the resistive material to achieve a desired radiation pattern is most easily done by first determining the frequency range of operation of the loudspeaker assembly (generally more control is possible for narrower frequency ranges of operation); then determining the range of directivity desired (generally, a narrower range of directivity is possible to achieve for a narrower ranges of operation); and modeling the parameters to yield the desired result using finite element modeling that simulates the propagation of sound waves.

Figure 7A:
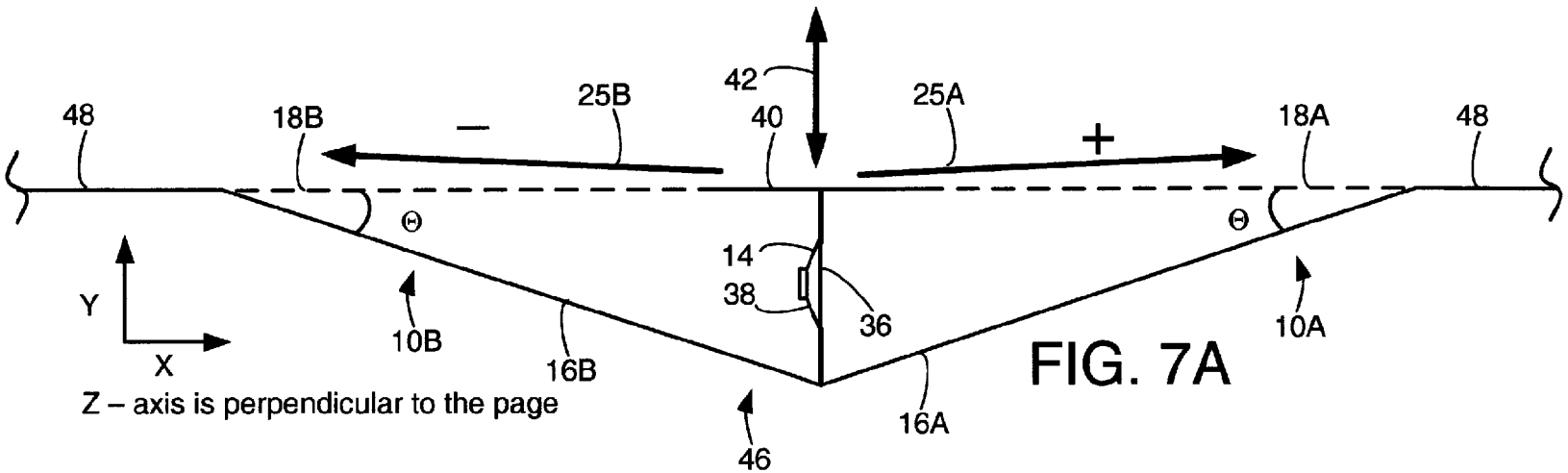
FIGS. 7A and 7B are diagrammatic views of a directional loudspeaker assembly.
Figure 7B:
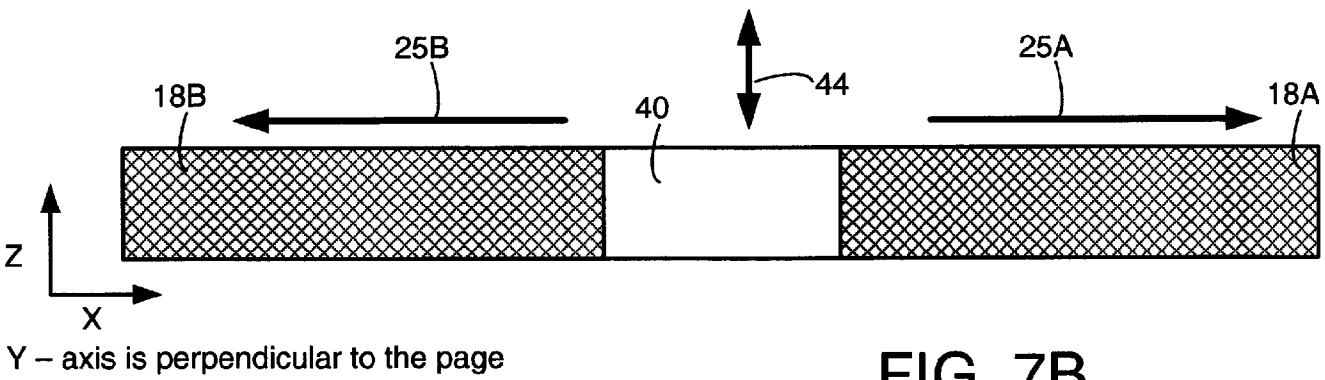

FIGS. 7A and 7B show another implementation of the loudspeaker assembly of FIGS. 5F and 5G. A loudspeaker system 46 includes a first acoustic device for radiating acoustic energy to the environment, such as a first loudspeaker assembly 10A and a second acoustic device for radiating acoustic energy to the environment, such as a second loudspeaker assembly 10B. The first loudspeaker subassembly 10A includes the elements of the loudspeaker assembly of FIGS. 5F and 5G and operates in a manner similar to the loudspeaker assemblies of FIGS. 5F and 5G. Pipe 16A, slot 18A, directional arrow 25A and acoustic driver 14 correspond to pipe 16, slot 18, directional arrow 25, and acoustic driver 14 of FIGS. 5F and 5G. The acoustic driver 14 is mounted so that one surface 36 radiates into pipe 16A and so that a second surface 38 radiates into a second loudspeaker subassembly 10B including pipe 16B with a slot 18B. The second loudspeaker subassembly 10B includes the elements of the loudspeaker assembly of FIGS. 5F and 5G and operates in a manner similar to the loudspeaker assemblies of FIGS. 5F and 5G. The first loudspeaker subassembly 10A is directional in the direction indicated by arrow 25A and the second loudspeaker subassembly 10B is directional in the direction indicated by arrow 25B. Slots 18A and 18B are separated by a baffle 40. The radiation from the first subassembly 10A is out of phase with the radiation from second assembly 10B, as indicated by the "+" adjacent arrow 25A and the "−" adjacent arrow 25B. Because the radiation from first subassembly 10A and second subassembly 10B is out of phase, the radiation tends to combine destructively in the Y axis and Z directions, so that the radiation from the loudspeaker assembly of FIGS. 7A and 7B is directional along one axis, in this example, the X-axis. The loudspeaker assembly 46 can be made to be mounted in a wall 48 and have a radiation pattern that is directional in a horizontal direction substantially parallel to the plane of the wall. Such a device is very advantageous in venues that are significantly longer in one direction than in other directions. Examples might be train platforms and subway stations. In appropriate situations, the loudspeaker could be mounted so that it is directional in a vertical direction.

Figure 8A:
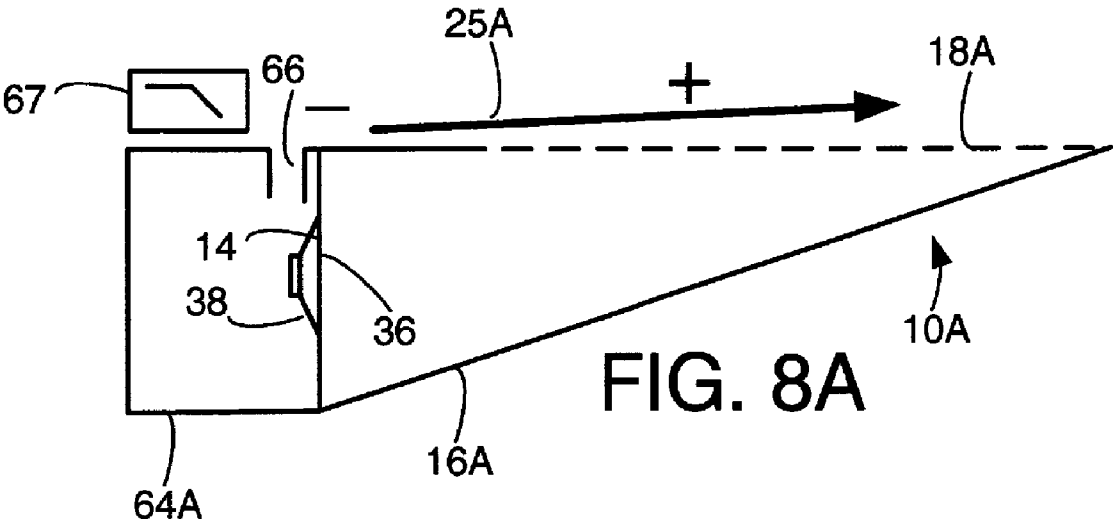
FIGS. 8A and 8B are diagrammatic views of a directional loudspeaker assembly.
Figure 8B:
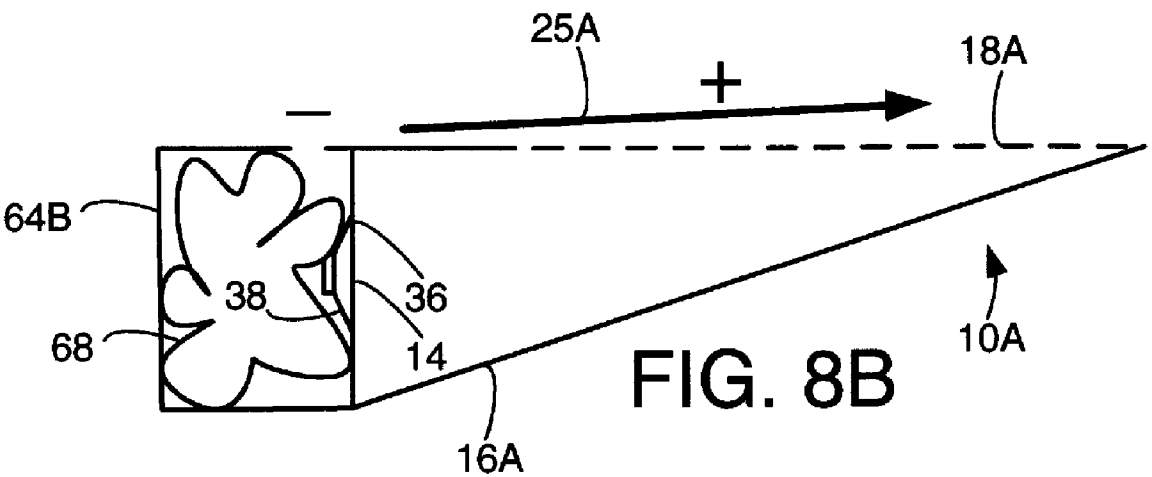

FIGS. 8A-8B show another loudspeaker assembly. The implementations of FIGS. 8A-8B include a first acoustic device 10A, similar to subassembly 10A of FIGS. 7A-7B. FIGS. 8A-8B also include a second acoustic device 64A, 64B coupling the second surface 38 of the acoustic driver 14 to the environment. The second device 64A, 64B is configured so that more low frequency acoustic energy than high frequency acoustic energy is radiated. In FIG. 8A, second device 64A includes a port 66 configured to act as a low pass filter as indicated by low pass filter indicator 67. In FIG. 8B, second device 64B includes damping material 68 that damps high frequency acoustic energy more than it damps low frequency acoustic energy. The devices of FIGS. 8A and 8B operate similarly to the device of FIGS. 7A and 7B. However because the second devices 64A and 64B of FIGS. 8A and 8B respectively radiate more low frequency radiation than high frequency radiation, the out-of-phase destructive combining occurs more at lower frequencies than at higher frequencies. Therefore, the improved directional effect of the devices of FIGS. 8A and 8B occurs at lower frequencies. However, as stated above, at higher frequencies with corresponding wavelengths that are much shorter than the length of the slot 18, the first subassembly becomes directional without any canceling radiation from second device 64A and 64B. Therefore, a desired degree of directionality can be maintained over a wider frequency range, that is, without becoming more directional than desired at high frequencies.

Figure 9:
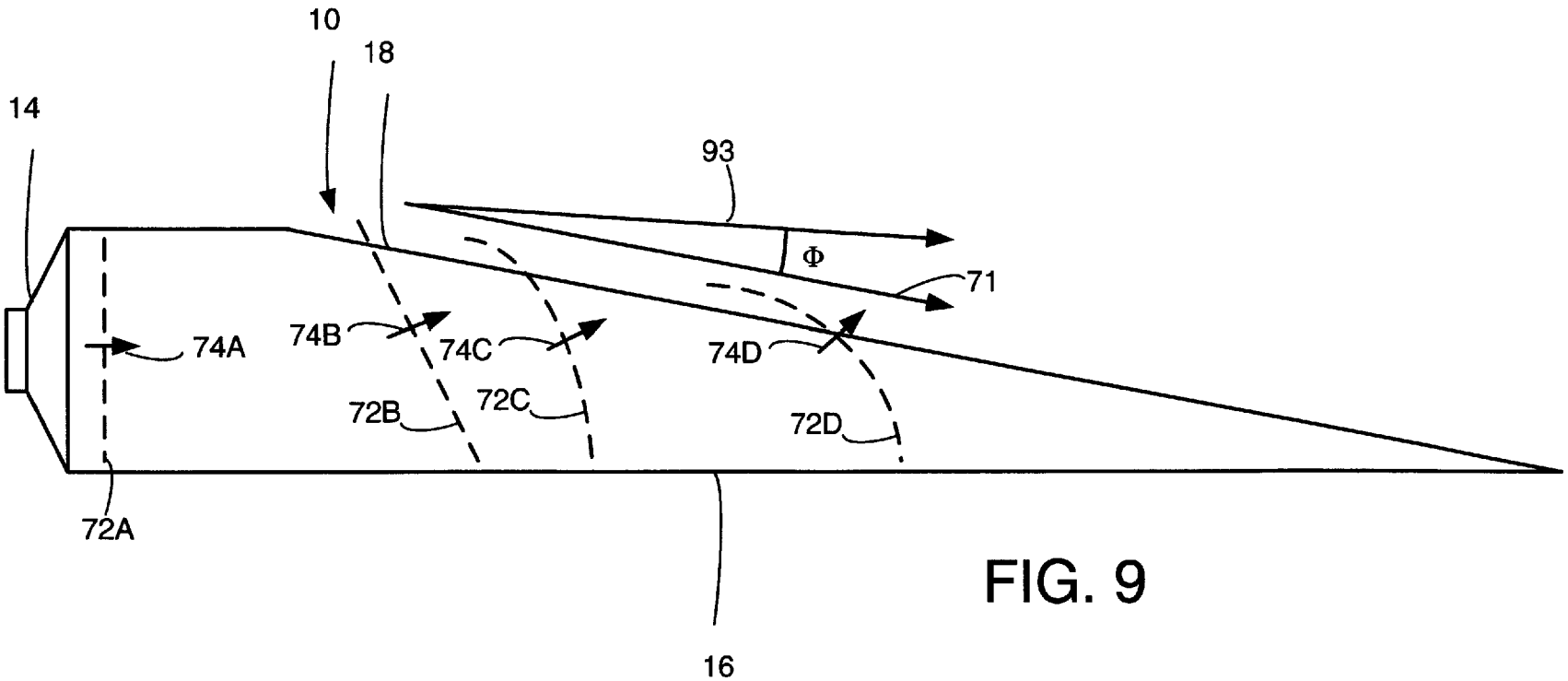
FIG. 9 is a diagrammatic view of a directional loudspeaker assembly illustrating the direction of travel of a sound wave and directionality of a directional loudspeaker.

FIG. 9, shows more detail about the direction of directionality. FIG. 9 shows a loudspeaker device 10 that is similar to the loudspeaker device of FIGS. 4A-4E. Generally, the loudspeaker is directional in a direction parallel to the direction of travel of the wave, indicated by arrow 71, which is generally parallel to the slot. Within the pipe 16, near the acoustic driver 14, the wave is substantially planar and the direction of travel is substantially perpendicular to the plane of the planar wave as indicated by wavefront 72A and arrow 74A. When the wavefront reaches the screen 18, the resistance of the screen 18 slows the wave, so the wave "tilts" as indicated by wavefront 72B in a direction indicated by arrow 74B. The amount of tilt is greatly exaggerated in FIG. 9. In addition, the wave becomes increasingly nonplanar, as indicated by wavefronts 72C and 72D; the non-planarity causes a further "tilt" in the direction of travel of the wave, in a direction indicated by arrows 74C and 74D. The directionality direction is the sum of the direction indicated by arrow 71 and the tilt indicated by arrows 74B, 74C, and 74D. Therefore, the directionality direction indicated by arrow 93 is at an angle $\phi$ relative to direction 71 which is parallel to the plane of the slot 18. The angle $\phi$ can be determined by finite element modeling and confirmed empirically. The angle $\phi$ varies by frequency.

Other embodiments are in the claims.

What is claimed is:

1. An acoustic apparatus, comprising:

an acoustic driver, acoustically coupled to a pipe to radiate acoustic energy into the pipe, the pipe comprising an elongated opening along at least a portion of the length of the pipe through which acoustic energy is radiated to the environment, the radiating characterized by a volume velocity, the pipe and the opening configured so that the volume velocity is substantially constant along the length of the pipe.

2. An acoustic apparatus in accordance with claim 1, wherein the pipe is configured so that the pressure along the pipe is substantially constant.

3. An acoustic apparatus in accordance with claim 2, wherein the cross-sectional area decreases with distance from the acoustic driver.

4. An acoustic apparatus in accordance with claim 1, further comprising acoustically resistive material in the opening.

5. An acoustic apparatus in accordance with claim 4, wherein the resistance of the acoustically resistive material varies along the length of the pipe.

6. An acoustic apparatus in accordance with claim 4, wherein the acoustically resistive material is wire mesh.

7. An acoustic apparatus in accordance with claim 4, wherein the acoustically resistive material is sintered plastic.

8. An acoustic apparatus in accordance with claim 4, wherein the acoustically resistive material is fabric.

9. An acoustic apparatus in accordance with claim 4, the pipe and the opening configured and dimensioned and the resistance of the resistive material selected so that substantially all of the acoustic energy radiated by the acoustic driver is radiated through the opening before the acoustic energy reaches the end of the pipe.

10. An acoustic apparatus in accordance with claim 1, wherein the width of the opening varies along the length of the pipe.

11. An acoustic apparatus in accordance with claim 10, wherein the opening is oval shaped.

12. An acoustic apparatus in accordance with claim 1, wherein the cross-sectional area of the pipe varies along the length of the pipe.

13. An acoustic apparatus in accordance with claim 12, wherein the opening lies in a plane that intersects the pipe at a non-zero, non-perpendicular angle relative to the axis of the acoustic driver.

14. An acoustic apparatus in accordance with claim 1, wherein the pipe is at least one of bent or curved.

15. An acoustic apparatus in accordance with claim 14, wherein the opening is at least one of bent or curved along its length.

16. An acoustic apparatus in accordance with claim 14, wherein the opening is in a face that is at least one of bent or curved.

17. An acoustic apparatus in accordance with claim 1, the opening lying in a plane that intersects an axis of the acoustic driver at a non-zero, non-perpendicular angle relative to the axis of the acoustic driver.

18. An acoustic apparatus in accordance with claim 17, the opening conforming to an opening formed by cutting the pipe at a non-zero, non-perpendicular angle relative the axis.

19. An acoustic apparatus in accordance with claim 1, the pipe and the opening configured and dimensioned so that substantially all of the acoustic energy radiated by the acoustic driver is radiated through the opening before the acoustic energy reaches the end of the pipe.

20. An acoustic apparatus in accordance with claim 1, wherein the acoustic driver has a first radiating surface acoustically coupled to the pipe and wherein the acoustic driver has a second radiating surface coupled to an acoustic device for radiating acoustic energy to the environment.

21. An acoustic apparatus in accordance with claim 20, wherein the acoustic device is a second pipe comprising an elongated opening along at least a portion of the length of the second pipe through which acoustic energy is radiated to the environment, the radiating characterized by a volume velocity, the pipe and the opening configured so that the volume velocity is substantially constant along the length of the pipe.

22. An acoustic apparatus in accordance with claim 20, wherein the acoustic device comprises structure to reduce high frequency radiation from the acoustic enclosure.

23. An acoustic apparatus in accordance with claim 22, wherein the high frequency radiation reducing structure comprises damping material.

24. An acoustic apparatus in accordance with claim 22, wherein the high frequency radiation reducing structure comprises a port configured to act as a low pass filter.

25. A method for operating a loudspeaker device, comprising:

radiating acoustic energy into a pipe; and radiating the acoustic energy from the pipe through an elongated opening in the pipe with a substantially constant volume velocity.

26. A method for operating a loudspeaker device in accordance with claim 25, wherein the radiating from the pipe comprises radiating the acoustic energy so that the pressure along the opening is substantially constant.

27. A method for operating a loudspeaker device in accordance with claim 25, further comprising radiating the acoustic energy from the pipe through the opening through acoustically resistive material.

28. A method for operating a loudspeaker device in accordance with claim 27, further comprising radiating the acoustic energy from the pipe through the opening through acoustically resistive material that varies in resistance along the length of the pipe.

29. A method for operating a loudspeaker device in accordance with claim 27, further comprising radiating the acoustic energy from the pipe through wire mesh.

30. A method for operating a loudspeaker device in accordance with claim 27, further comprising radiating the acoustic energy from the pipe through a sintered plastic sheet.

31. A method for operating a loudspeaker device in accordance with claim 25 further comprising radiating the acoustic energy from the pipe through an opening that varies in width along the length of the pipe.

32. A method for operating a loudspeaker device in accordance with claim 31 further comprising radiating the acoustic energy from the pipe through an oval shaped opening.

33. A method for operating a loudspeaker device in accordance with claim 25, further comprising radiating acoustic energy into a pipe that varies in cross-sectional area along the length of the pipe.

34. An acoustic apparatus in accordance with claim 25, further comprising radiating acoustic energy into at least one of a bent or curved pipe.

35. A method for operating a loudspeaker device in accordance with claim 25, further comprising radiating acoustic energy from the pipe through an opening that is at least one of bent or curved along its length.

36. A method for operating a loudspeaker device in accordance with claim 35, further comprising radiating acoustic energy from the pipe through an opening in a face of the pipe that is at least one of bent or curved.

37. A method for operating a loudspeaker device in accordance with claim 25, further comprising radiating acoustic energy from the pipe through an opening lying in a plane that intersects a axis of the acoustic driver at a non-zero, non-perpendicular angle.

38. A method for operating a loudspeaker device in accordance with claim 37, further comprising radiating acoustic energy from the pipe through an opening that conforms to an opening formed by cutting the pipe at a non-zero, non-perpendicular angle relative the axis.

39. A method for operating a loudspeaker device in accordance with claim 25, further comprising radiating substantially all of the energy from the pipe before the acoustic energy reaches the end of the pipe.

* * * * *